US007357148B1

(12) United States Patent
Gibson

(10) Patent No.: US 7,357,148 B1
(45) Date of Patent: Apr. 15, 2008

(54) PREFABRICATED IN-WALL WATER SERVICE BOX

(76) Inventor: Michael Gibson, 1648 Riverside Dr., Glendale, CA (US) 91201

( * ) Notice: Subject to any disclaimer, the term of this patent is extended or adjusted under 35 U.S.C. 154(b) by 18 days.

(21) Appl. No.: 11/356,503

(22) Filed: Feb. 17, 2006

(51) Int. Cl.
*F16L 5/00* (2006.01)

(52) U.S. Cl. ..... 137/360

(58) Field of Classification Search ..... 137/360; 220/3.2, 3.3

See application file for complete search history.

(56) References Cited

U.S. PATENT DOCUMENTS

| | | | | | |
|---|---|---|---|---|---|
| 2,952,271 | A | | 9/1960 | Dick et al. | |
| 3,096,782 | A | * | 7/1963 | Williams | 137/360 |
| 3,148,698 | A | | 9/1964 | Silbley | |
| 3,718,154 | A | | 2/1973 | Doumany | |
| 3,862,433 | A | * | 1/1975 | Rousselet | 307/118 |
| 3,996,959 | A | | 12/1976 | Caruth | |
| 4,158,471 | A | * | 6/1979 | Logsdon | 312/229 |
| 4,167,196 | A | | 9/1979 | Morris | |
| 4,637,422 | A | * | 1/1987 | Izzi, Sr. | 137/360 |
| 5,538,033 | A | | 7/1996 | Condon | |
| 5,566,708 | A | * | 10/1996 | Hobbs, Jr. | 137/360 |
| 5,653,254 | A | | 8/1997 | Condon et al. | |
| D411,870 | S | | 7/1999 | Humber | |
| 5,983,923 | A | * | 11/1999 | Hobbs et al. | 137/360 |
| 6,234,193 | B1 | * | 5/2001 | Hobbs et al. | 137/360 |
| 6,581,627 | B2 | * | 6/2003 | Dillon | 137/360 |
| 6,695,001 | B2 | | 2/2004 | Dicosola | |
| 6,845,786 | B1 | | 1/2005 | Condon | |
| 2005/0067017 | A1 | | 3/2005 | Condon et al. | |

* cited by examiner

*Primary Examiner*—Ramesh Kirshnamurthy
*Assistant Examiner*—Cloud Lee
(74) *Attorney, Agent, or Firm*—Wagner, Anderson & Bright, LLP; Roy L Anderson

(57) ABSTRACT

A prefabricated in-wall water service box with a five sided deep drawn stainless steel enclosure that has an open side with a reservoir lip and three closed sides integral with a top and bottom so that a reservoir is formed that is drained through a drain hole into a stainless steel nipple that is welded to the bottom and extends downwardly from the drain hole while hot and cold water control valves are mounted inside the enclosure through holes to a fittings located outside the enclosure at its two side walls. A trim bezel with a planar facing flush with a mounting wall is secured to the enclosure when it is mounted to two studs by two mounting brackets affixed to the two side walls by stainless steel screws. The hot and cold water control valves are ninety degree stainless steel ball valves while the brass hot and cold water fittings are a ninety degree elbow connected to an extension nipple that can accept a sweated copper connection, a compression fitting and a direct pipe thread connection while the side walls, the bottom and the top are joined with the back wall by four ninety degree radius turns.

2 Claims, 4 Drawing Sheets

PREFABRICATED IN-WALL WATER SERVICE BOX

FIELD OF THE INVENTION

This invention is in the field of prefabricated in-wall mounted washing machine water supply and drain enclosures.

BACKGROUND OF THE INVENTION

In-Wall Water Supply Enclosures.

The use of plastic and metal water supply enclosures has become widespread in the home construction and remodeling business in recent years. Their main purpose has been to supply hot/cold water and a drain to washing machines while providing these items in a low profile enclosure recessed into or flush with the wall behind the appliance. Various attempts have been made to address issues that arise when installing the enclosure into the wall space.

Plastic.

Enclosures manufactured from plastic have become the most popular in recent years due to their low initial cost made possible by injection molded manufacturing.

The limitations of the injection molded enclosures pose many problems during installation and use. The semi-rigid plastics from which the enclosures are manufactured, while corrosion resistance, are relatively fragile. The delicacy with which they have to be installed, without breaking, will challenge even the most experienced plumber. The mounting tabs have a tendency to crack when struck by the hammer driving nails, or from driving screws with a screw gun into the structural wall framing. The plastic enclosures have a tendency to distort from the stresses applied to them from the plumbing lines; both supply and drain, during installation. Heat from the act of soldering the supply line into the enclosure fittings can lead to extreme distortion of the enclosure, if not actual melting of the plastic.

The above mentioned distortion can also lead to an issue with the ability of the trim bezel to properly mate to the enclosure. As a general rule, the plastic trim bezel mounts to the enclosure by means of notched serrations on the interior of the enclosure. If the enclosure is distorted in any way, the trim bezel will not align properly with the enclosure and will not provide a suitable/attractive appearance.

Metal Enclosure.

A solution the structural inadequacies of die injected plastic enclosures is a metal enclosure.

Metal enclosures have solved the problems of insufficient rigidity during installation; they will not distort in shape due to pressures applied by direct installation, attachment of supply and drain lines or installation of wall material. These enclosures allow the trim bezel to be attached to the enclosure by means of screws that pass through the trim bezel and thread in to the enclosure, allowing for a tighter and cleaner fit to the finished wall.

One of the problems metal enclosures present are extensive costs in fabrication. Brake formed and welded enclosures are labor intensive.

The material from which the enclosure is manufactured has also been a point of serious concern. Enclosures manufactured from cold rolled steel, painted, powder coated or galvanized are still manufactured from steel. Steel in the best environment will still corrode; rust is the material specific term. Any failure of the coating will expose the base steel to moisture, leading to the degradation of the base metal, which will lead to a leak in to the hidden wall area behind and below the enclosure.

One issue that current plastic and metal enclosures have in common is the lack of a means to ensure that any leaks from faulty hoses, hose washers, or valve failure will be directed into the drain connection as opposed to leaking into the wall area behind or below the enclosure. Any such leakage in the wall area will eventually lead to mildew, mold and structural damage, all of which have an extremely high repair cost, not to mention potential issues of liability.

As the enclosure is mounted within a stud bay of a wall and is typically at least partially hidden behind the washing machine or dryer within the laundry room, any leakage may go undetected for an extended period of time. As a majority of the previously designed enclosures had no reservoir in the bottom of the enclosure to collect and direct any leakage into the drain line, or had supply lines entering the bottom of the enclosure, relying on rubber gaskets to seal the bottom of the enclosure, the present invention solves such problems by using an enclosure with an integral reservoir and supply lines entering the enclosure from the side, well above the top lip of the reservoir.

An example of the hidden damages that can accumulate after an extended period of time can be told by a fellow contractor's account. The enclosure that failed was a metal model. The means of fabrication were brake forming and spot welds to hold general shape. The finish of this particular cold rolled steel box was a white powder-coat to inhibit rust and provide an attractive end product. The water supply lines entered from the bottom of the enclosure using gaskets to seal the entrance and drain points.

The contractor purchased an existing home in southeast Tennessee. The previous owner moved out two months prior to the contractor's move in date. During those two months, the moisture in the wall space and flooring had an opportunity to dry out. The contractor's family took occupancy in October and starting doing laundry for a family of five. By the following spring, they began to detect buckling of the flooring and degradation of the wall board. Upon removal of the washer and dryer from the laundry room, they found massive mildew, mold and structural damage to the home. The damage found required replacement or repair of the ring joist, eight wall studs, five floor joists, 128 square feet of drywall, 150 square feet of sub-flooring, 200 square feet of flooring material, 200 square feet of sub-floor insulation, and painting the new drywall.

All damage discovered was linked to a faulty cold water valve which leaked inside the enclosure. The leak, which was small enough to stay undetected, remained inside the wall space where the metal enclosure was installed. The water from the leak had made its escape past the enclosure three different ways. First, was the water simply rolled forward in the enclosure behind the trim ring. There was no lip or ridge to contain water in the bottom of the enclosure. Second, the water passed through the corners of the side and bottom of the enclosure. The corners that were joined in the fabrication of the enclosure were only spot welded after being braked. Third, after an extended period of time, the water penetrated around the gaskets in the holes provided for the hot and cold water inlets which also caused corrosion to the powder-coated finish. If this metal enclosure had been capable of collecting a leak of that size and directing that water to the drain, the damage would have been limited to the failure of the cold water valve which is where the whole incident started. The cold water valve could have been replaced the next time the washing machine was pulled out and the enclosure was inspected.

The only other known product on the market available to replace this faulty metal enclosure, at that time, was a plastic enclosure. When purchasing the plastic enclosure the contractor realized immediately that there was nothing different in the design of this enclosure that would prevent water from running into the wall space. A leaking valve again could easily run over the front opening of the enclosure or penetrate around one of the valves coming through the bottom of the enclosure, creating the same damage he had just repaired. The ease of installation was also questionable. One of the mounting brackets broke as he screwed the bracket to the wall. That led to twisting of the enclosure as he mounted the other bracket. Even though he accurately measured and mounted the enclosure, the notched finish bezel would not click into the enclosure to provide a tight fit to the wall, which required the use of silicone to fill the gap between the wall and the trim bezel.

Health Hazards.

The area behind a washer and dryer is a perfect environment for mildew and mold to grow. Water from a leak that's within a dark wall space and heated by the exhaust of nearby dryers only accelerate the environments potential for mold and mildew to flourish. The degree of health concern associated with mold depends on the length of exposure, degree of exposure, and an individual's sensitivity to molds. In individuals who are sensitive to molds, common health concerns include hay fever-like allergic symptoms—eye irritation (burning, watery, redness), nose or throat irritation (sneezing fits, nasal stuffiness, bloody noses; dry, hacking cough), respiratory problems (wheezing, asthma attacks, difficulty breathing), headaches, and skin rashes—as well as fungal infections in those with immune suppression or pre-existing lung disease. A few people in homes with mold have developed pulmonary hemorrhage (bleeding in the lungs) or memory loss, but these cases are rare and the link to mold as the cause of these health problems has not been fully proven. Individuals most at risk for health problems due to inhaling mold spores are infants and children, pregnant women, people with compromised immune systems, individuals with existing respiratory conditions, individuals with allergies, and the elderly.

Accordingly there has been a long felt need to provide an in-wall water supply enclosure that is easy to install, durable during installation and duration of use, and that provides a leak proof reservoir enabling the enclosure to capture leaks from within the structure. All of these needs would need to be met while still providing a low-cost means of fabrication.

SUMMARY OF THE INVENTION

The present invention is generally directed to a prefabricated in-wall water service box with a five sided deep drawn stainless steel enclosure that has an open side with a reservoir lip and three closed sides integral with a top and bottom so that a reservoir is formed that is drained through a drain hole into a stainless steel nipple that is welded to the bottom and extends downwardly from the drain hole while hot and cold water control valves are mounted inside the enclosure through holes to a fittings located outside the enclosure at its two side walls.

In a first, separate group of aspects of the present invention, a trim bezel (which may also be made of deep drawn stainless steel) is mounted within the enclosure so that it has a planar facing that is flush with a mounting wall and the service box is mounted to two studs by two mounting brackets affixed to the two side walls (preferably by stainless steel screws).

In a second, separate group of aspects of the present invention, the hot and cold water control valves are ninety degree stainless steel ball valves while the hot and cold water fittings (preferably made of brass) are a ninety degree elbow connected to an extension nipple that can accept a sweated copper connection, a compression fitting and a direct pipe thread connection while the side walls, the bottom and the top are joined with the back wall by four ninety degree radius turns.

Accordingly, it is a primary object of the present invention to provide an improved prefabricated in-wall water service box.

This and further objects and advantages will be apparent to those skilled in the art in connection with the drawings and the detailed description of the invention set forth below.

DETAILED DESCRIPTION OF THE INVENTION

The present invention seeks to solve the problems associated with present day prefabricated in-wall mounted washing machine water supply and drain enclosures by, generally speaking, using a deep drawn stainless steel enclosure with an integrated leak proof bottom incorporating two 90° turn stainless steel valves entering the enclosure from its sides, inlet nipples that can accept sweated copper connections, compression fittings or direct pipe thread connections, and a welded stainless steel male pip nipple centered in the base of the enclosure to facilitate access for a washing machine waste line with a depth adjustable face plate to add an attractive finished exterior view.

The present invention will now be discussed in connection with a preferred embodiment shown in FIGS. 1-11.

In the Figures and the following more detailed description, numerals indicate various features of the invention, with like numerals referring to like features throughout both the drawings and the description. Although the Figures are described in greater detail below, the following is a glossary of the elements identified in the Figures.

| | |
|---|---|
| 1 | stainless steel enclosure (or water service box) |
| 1A | bottom side of 1 |
| 1B | top side of 1 |
| 1C | first side wall of 1 |
| 1D | back wall of 1 |
| 1E | second side wall of 1 |
| 2 | trim bezel |
| 3 | mounting bracket |
| 4 | hot water control valve |
| 5 | lock nut |
| 6 | ninety degree elbow |
| 7 | extension nipple |
| 8 | welding |
| 9 | nipple |
| 10 | reservoir lip |
| 11 | slot for adjustable wall depth |
| 12 | ¾ inch ninety degree radius turn (for ease of metal draw) |
| 13 | 5/16 inch ninety degree radius turn (for ease of metal draw) |
| 14 | ¾ inch ninety degree radius turn |
| 15 | 5/16 inch ninety degree radius turn |
| 16 | dimpled and threaded screw holes |
| 17 | pre-drilled holes |
| 18 | control valve hole |
| 19 | drain line |
| 20 | stud |
| 21 | ¾ inch ninety degree radius turn |
| 22 | mounting bracket pass through holes |
| 23 | dimpled and threaded screw holes |
| 24 | cold water control valve |
| 25 | screw |
| 26 | red hot water control valve handle |
| 27 | blue cold water control valve handle |
| 28 | reservoir |
| 29 | hot water control valve hole |
| 30 | lip |
| 31 | facing |

Figure 1:
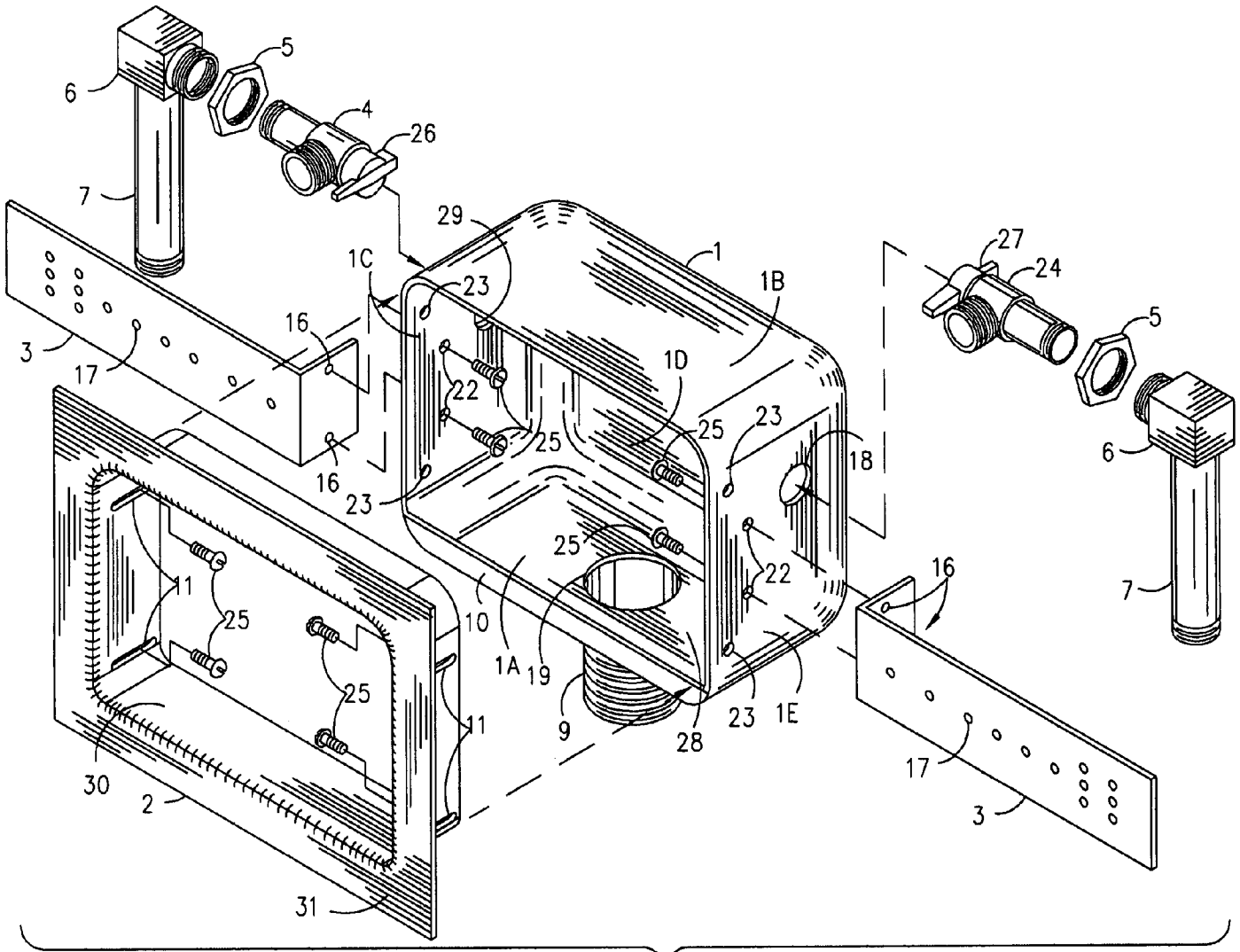
FIG. 1 is an exploded assembly view of a preferred embodiment of the present invention.
Figure 2:
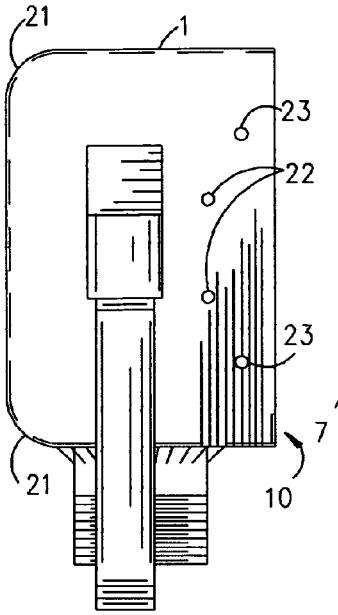
FIGS. 2 and 7 are partial left and right side views, respectively, of the preferred embodiment of FIG. 1 without the trim bezel or mounting bracket.
Figure 3:
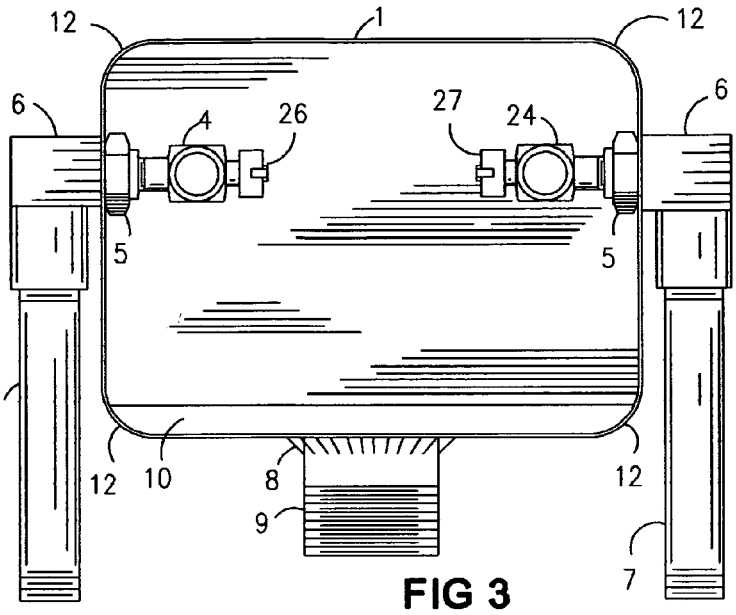
FIG. 3 is a front face view of the preferred embodiment of FIG. 1.
Figure 4:
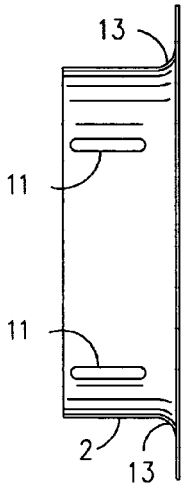
FIGS. 4 and 6 are left and right side views, respectively, of the trim bezel of FIG. 1.
Figure 5:
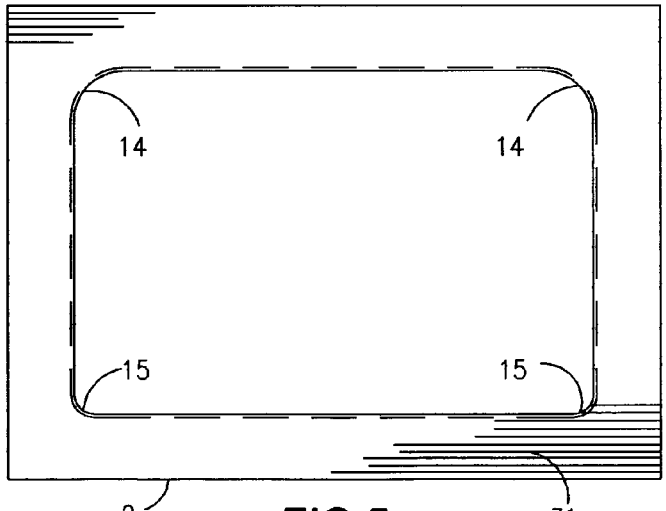
FIG. 5 is a front face view of the trim bezel of FIG. 1.
Figure 6:
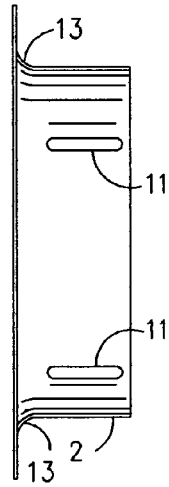
Figure 7:
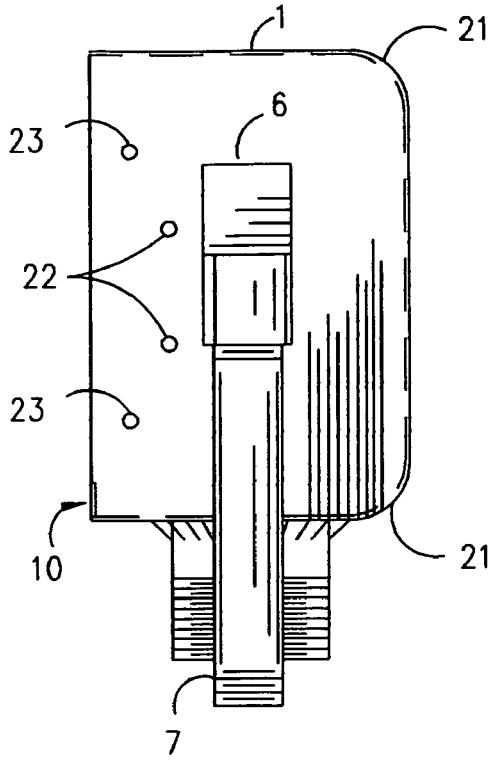
Figure 8:
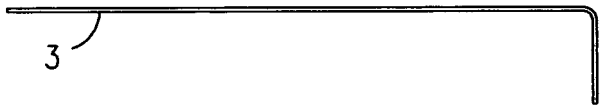
FIG. 8 is a bottom view of the mounting bracket of FIG. 1.
Figure 9:
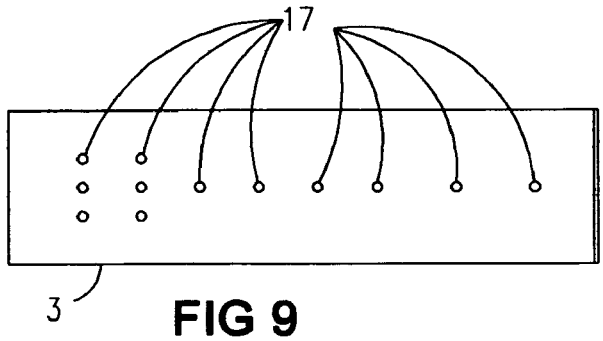
FIG. 9 a front face view of the mounting bracket of FIG. 1.
Figure 10:
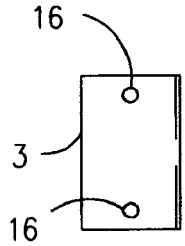
FIG. 10 is a side view of the mounting bracket of FIG. 1.
Figure 11:
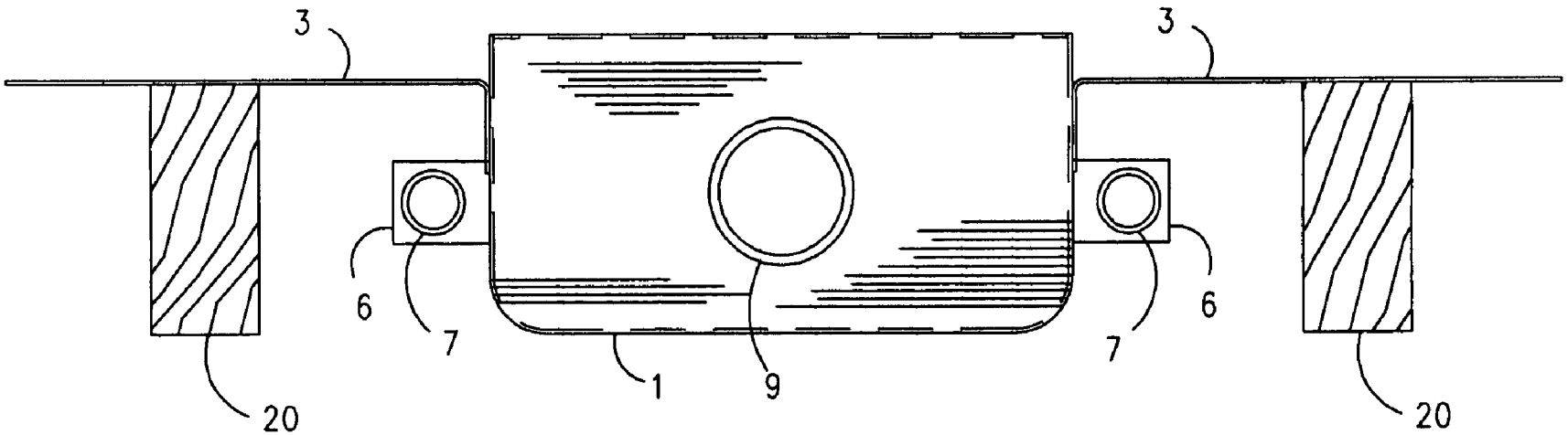
FIG. 11 is a bottom mounted view of the preferred embodiment of the present invention mounted on two 2×4 wall studs on 16 inch center without wall boarding or the trim bezel of FIG. 1.

As shown in FIGS. 1 and 3, a deep drawn five sided stainless steel enclosure (or water service box) 1 has a bottom 1A, a top 1B, a first side wall 1C, a back wall 1D and a second side wall 1E, which is very similar in geometry to a pan that is turned up 90° on one of its long sides. It is especially preferred that each of the sides or walls of enclosure 1 is generally planar except for its corners where it meets other sides, but they need not be, and the term side or wall in this context should not be interpreted or limited to a generally planar construction, although that is certainly a very economical construction. It is especially preferred that enclosure 1 be a solid one-piece 18-gauge 304 series stainless steel construction so it will offer a durable box material that will provide superior corrosion resistance and ease of installation of valve hardware without being subject to corrosion or leaks. Due to the deep drawing process, the four corners 21 at the back of enclosure 1 will, preferably, have a ¾ inch ninety degree radius turn (see FIG. 7) while there will be ¾ inch 90° turns 12 toward the front of enclosure 1 (see FIG. 3) for ease of metal draw.

Bottom 1A of enclosure 1 has drain line 19 welded to nipple 9 (which is preferably made of stainless steel). The integrated drain nipple 9 in bottom 1A of enclosure 1 is of sufficient diameter (preferably two inches) to facilitate insertion of any washing machine drain hose available on the market today. By welding drain nipple to bottom 1A a permanent leak proof bottom of enclosure 1A is ensured. A reservoir lip 10 forms a reservoir shown generally as 28 to create an integrated leak proof bottom of enclosure 1 that will prevent any leakage that could occur during connection or disconnection of the supply lines or from the valves, should they develop stem leakage, from entering the area below the enclosure into the wall space which over an extended period of time could lead to structural damage and mildew or mold, both of which can lead to health and liability concerns. Any leakage that should occur will be retained with the enclosure and have free flow into drain pipe nipple 19 which is preferably located in the center of bottom 1A.

A hot water control valve 4 (preferably with red hot water control valve handle 26) and a cold water control valve 24 (preferably with blue cold water control valve handle 27) are fitted inside of enclosure 1 and each is secured by a lock nut 5 to ninety degree elbow 6 that is connected to an extension nipple 7. It is especially preferred that control valves 4 and 24 be brass bodied chrome plated stainless steel ball 90° rotation ball valves with powder coated handles and that the lock nuts 5, elbows 6 and nipples 7 be made of brass. Brass elbows 6 may be rotated to provide water supply from any angle above, behind or below enclosure 1. Brass nipples 7 may be connected to the water supplies by means of seated copper pipe into the internal diameter of the nipple, compression nut attachment to the external thread of the nipple, or by direct connection by means of a pipe coupling attached to rigid pipe.

Enclosure 1 will be mounted into a wall space by means of two opposing mounting brackets 3 extending outwardly from first and second side walls 1C and 1E and attached to wall studs 20 (see FIG. 11) by nails, screws or an acceptable method (not shown). Brackets 3 have pre-drilled holes 17 with multiple attachment patterns for ease of mounting to studs 20 and dimpled and threaded screw holes 16 (for 10-32 stainless screws) to attach the brackets to enclosure 1 and are, preferably, made of 18 gauge stainless steel. The enclosure can be mounted in any wall bay constructed with standard 16 inch or center construction. Each mounting bracket 3 is attached to enclosure 1 by means of two stainless steel Phillips pan head machine screws 25 that pass through holes 22 in the sides of enclosure 1 and thread into the mounting brackets. The fixed depth of the mounting brackets to the sides of the enclosure will assure that the front face of the enclosure will have a standard mounting of ⅜ of an inch outward from the wall studs. As the standard wall board thickness used in construction is ½ of an inch or thicker, this assures that there will be no possibility of the enclosure being mounted in a condition where the face of the enclosure could extend past the wall board.

Trim bezel (or face plate) 2 for enclosure 1 is also a deep drawn stainless steel component with a lip 30 and planar facing 31. It is designed with a slight pressure roll on the outer edges and a brushed finish to facilitate an attractive appearance when installed against the finished wall. For ease of metal draw, it will have 5/16 90° radius turns 13 (see FIGS. 4 and 6) and 15 (see FIG. 5) and ¾ inch 90° radius turns 14 (see FIG. 5). Trim bezel 2 mounts in enclosure 1 by means of four stainless steel Phillips pan head machine screws 25 that pass through horizontal slots 11 in lip 30 and thread into enclosure 1 through dimpled and threaded screw holes 23 (for 10-32 stainless screws). Horizontal slots 11 allow for variations in wall thickness from ⅜ of an inch to 1¼ of an inch.

While the invention has been described herein with reference to an especially preferred embodiment, this embodiment has been presented by way of example only, and not to limit the scope of the invention. In this regard, it should be noted that an especially preferred embodiment of the present invention utilizes a box enclosure with the dimensions of 6 inches tall by 8 inches wide by 4 inches deep while the trim bezel has dimensions of 7¼ inches tall by 9¾ inches wide;

however, these dimensions can certainly be varied and are only meant to be illustrative, and not limiting. Additional embodiments over what have been disclosed herein will be obvious to those skilled in the art having the benefit of this detailed description, especially to meet specific requirements or conditions. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. A prefabricated in-wall water service box mounted to a pair of studs in a wall, comprising:

a five sided deep drawn stainless steel enclosure having an open side with a reservoir lip, a back wall opposite the open side and the reservoir lip, a bottom with a drain line integral with the back side, a top integral with the back side and opposite the bottom, a first side wall with a hot water control valve hole integral with the bottom, the back wall and the top, a second side wall with a control valve hole both opposite the first side wall and with the bottom, the back wall and the top, the lip running along and extending upwardly from the bottom between the first and second side walls so as to form a reservoir drained by the drain line at the bottom of the box;

a hot water control valve with a first ninety degree stainless steel ball valve mounted inside the steel box through the hot water control valve hole to a first ninety degree elbow connected to an extension nipple hot water fitting located outside the steel box proximate the first side wall;

a cold water control valve mounted inside the steel box through the control valve hole to a second ninety degree elbow connected to an extension nipple cold water fitting located outside the steel box proximate the second side wall;

a stainless steel nipple welded to the bottom extending downwardly from the drain hole;

a stainless steel deep drawn trim bezel with a lip joined to a planar facing, said lip being mounted within the open side of the stainless steel enclosure and the planar facing extending outwardly beyond the first and second side walls, the bottom and the top opposite the back and being substantially flush with the wall;

a first mounting bracket affixed to the first side wall and a first stud, and a second mounting bracket affixed to the second side wall and the second stud;

wherein the hot water and cold water fittings are made of brass;

wherein the first and second mounting brackets are affixed to the first and second side walls, respectively, by a plurality of stainless steel screws; and wherein the plurality of stainless steel screws also secure the trim bezel to the enclosure.

2. A prefabricated in-wall water service box mounted to a pair of studs in a wall, comprising:

a five sided enclosure having an open side with a reservoir lip, a back wall opposite the open side and the reservoir lip, a bottom with a drain line integral with the back side, a top integral with the back side and opposite the bottom, a first side wall with a hot water control valve hole integral with the bottom, the back wall and the top, a second side wall with a control valve hole both opposite the first side wall and with the bottom, the back wall and the top, the lip running along and extending upwardly from the bottom between the first and second side walls so as to form a reservoir drained by the drain line at the bottom of the box;

a hot water control valve with a first ninety degree ball valve mounted inside the box through the hot water control valve hole to a first ninety degree elbow connected to an extension nipple hot water fitting located outside the box proximate the first side wall;

a cold water control valve mounted inside the box through the control valve hole to a second ninety degree elbow connected to an extension nipple cold water fitting located outside the steel box proximate the second side wall;

a nipple permanently affixed to the bottom extending downwardly from the drain hole;

a trim bezel with a lip joined to a planar facing, said lip being mounted within the open side of the enclosure and the planar facing extending outwardly beyond the first and second side walls, the bottom and the top opposite the back and being substantially flush with the wall;

a first mounting bracket affixed to the first side wall and a first stud; and a second mounting bracket affixed to the second side wall and the second stud;

wherein the first and second mounting brackets are affixed to the first and second side walls, respectively, by a plurality of screws; and wherein the plurality of screws also secure the trim bezel to the enclosure.

* * * * *